US009897060B2

(12) United States Patent
Wunderlich et al.

(10) Patent No.: US 9,897,060 B2
(45) Date of Patent: Feb. 20, 2018

(54) INJECTOR ARRANGEMENT FOR AN INTERNAL COMBUSTION ENGINE

(71) Applicant: Ford Global Technologies, LLC, Dearborn, MI (US)

(72) Inventors: Frank Wunderlich, Herzogenrath (DE); Joerg Kemmerling, Monschau (DE); Leonhard Bartsch, Aachen (DE); Juergen Karl Stief, Aachen (DE); Guohui Chen, Aachen (DE); Werner Willems, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/287,465

(22) Filed: Oct. 6, 2016

(65) Prior Publication Data

US 2017/0101973 A1 Apr. 13, 2017

(30) Foreign Application Priority Data

Oct. 8, 2015 (DE) ..... 10 2015 219 515

(51) Int. Cl.

| | |
|---|---|
| ***F02M 61/14*** | (2006.01) |
| ***F02M 61/18*** | (2006.01) |
| ***F02M 63/00*** | (2006.01) |
| ***F02M 61/04*** | (2006.01) |

(52) U.S. Cl.

CPC ..... *F02M 61/1806* (2013.01); *F02M 61/047* (2013.01); *F02M 61/14* (2013.01); *F02M 61/18* (2013.01); *F02M 63/0026* (2013.01); *F02M 2200/851* (2013.01)

(58) Field of Classification Search

CPC .... F02M 61/1806; F02M 61/14; F02M 61/18; F02M 63/0026; F02M 2200/851

USPC ..... 123/470

See application file for complete search history.

(56) References Cited

U.S. PATENT DOCUMENTS

| | | | | |
|---|---|---|---|---|
| 4,938,193 | A * | 7/1990 | Raufeisen | B25B 27/023 123/467 |
| 7,703,727 | B2 | 4/2010 | Selness | |
| 2004/0197713 | A1 | 10/2004 | Ohfuji et al. | |

FOREIGN PATENT DOCUMENTS

| | | | | |
|---|---|---|---|---|
| CH | 686635 | A5 * | 5/1996 | F02M 61/18 |
| CN | 202114508 | U | 1/2012 | |
| DE | 4022299 | A1 | 1/1992 | |
| DE | 102011086719 | A1 | 6/2012 | |
| WO | WO 2010004838 | A1 * | 1/2010 | F02B 23/101 |

* cited by examiner

*Primary Examiner* — Mahmoud Gimie

(74) *Attorney, Agent, or Firm* — Greg Brown; McCoy Russell LLP

(57) ABSTRACT

Methods and systems are provided for an injector arrangement for an internal combustion engine. In one example, an injector arrangement may include an actuator positioned between a fuel injector and a cylinder head, with the actuator configured to adjust a position of the fuel injector relative to the cylinder head in order to adjust a protrusion amount of a fuel nozzle tip within a combustion chamber.

20 Claims, 8 Drawing Sheets

INJECTOR ARRANGEMENT FOR AN INTERNAL COMBUSTION ENGINE

CROSS REFERENCE TO RELATED APPLICATIONS

This application claims priority to German Patent Application No. 102015219515.5, filed Oct. 8, 2015, the entire contents of which are hereby incorporated by reference for all purposes.

FIELD

The present description relates generally to methods and systems for a fuel injector arrangement for an internal combustion engine.

BACKGROUND/SUMMARY

Injectors or injection nozzles form significant components of an internal combustion engine. The injectors are used to inject fuel into respective cylinders before a fuel/air mixture is ignited by compression. Each injector is at least in most cases arranged in a respective recess provided in a cylinder head of the engine. Each injector includes a valve, which is opened for injection. This can be accomplished, on the one hand, by means of a pressure pulse produced by a pump associated with the individual injector. On the other hand, it is also possible for the valve to be controlled electromagnetically, wherein all of the injectors are supplied by a common pressure reservoir. Depending on the design of the engine, injection is performed directly into the combustion chamber (direct injection), wherein the piston top often has an annular recess, or alternatively into a swirl chamber of a split combustion chamber (chamber-type engine).

In addition to the geometry of the injector, in particular the number, shape, size and alignment of openings via which the actual injection process takes place, the combustion process is decisively influenced by an amount of "nozzle tip protrusion". This is a measure of how far a forwardmost part of the injector, the nozzle tip, projects into the cylinder. However, different amounts of tip protrusion would be regarded as the optimum, depending on the cycle and the associated different operating points. This is due, on the one hand, to different requirements of the injection and combustion process (e.g. partial load or full load) and, on the other hand, to the fact that a large tip protrusion entails increased thermal stress on the nozzle tip at full load, reducing the life thereof, whereas this is a fairly minor problem at partial load.

The efficiency of the combustion process is determined by optimum mixture preparation, which, on the one hand, is achieved in terms of air involved by means of appropriate inlet ports and piston recess geometries and, on the other hand, in terms of the fuel involved by means of optimum introduction of the fuel through appropriate injection nozzle configuration. It should be noted here that the penetration depth (nozzle tip protrusion) of the injection nozzle is set in an optimum manner in accordance with the operating point. Low-load operating points at a relatively low engine speed, generally with a late injection event and a low injection pressure, require larger amounts of tip protrusion to achieve an optimum jet pattern in the combustion recess. With increasing load and engine speed and corresponding advance of the main injection event and increasing injection pressure, smaller amounts of nozzle tip protrusion are required to achieve a corresponding recess jet pattern. Injection jets outside the recess should be avoided for reasons connected with emissions (high HC, CO, soot figures).

In practice, the nozzle tip protrusion is chosen in such a way that it corresponds to a compromise. The nozzle tip protrusion is often adjusted by means of a rigid washer placed between the injector and the cylinder head, wherein a shoulder of the injector is supported on the washer, which, for its part, is supported on the cylinder head.

DE 40 22 299 C2 shows a height-adjustable washer having two washer parts lying one above the other and having contact surfaces which are embodied as rising helical surfaces, each having a ramp. In this case, at least two concentric helical surfaces are formed on each washer part, the ramps of said surfaces being offset relative to one another by a certain angle in the circumferential direction. The height of the washer was adjusted by twisting the washer parts relative to one another, wherein improved tilt stability of the washer parts relative to one another is achieved by means of the mutually offset ramps.

U.S. Pat. No. 7,703,727 B2 discloses an adjustable spacer arrangement having two wedge elements resting one upon the other, which are connected by at least one adjustable connecting arrangement. The latter is connected to the two wedge elements so as to be pivotable in all cases and engages with said elements via connecting elements, the spacing of which relative to one another can be varied. Varying the spacing has the effect that the wedge elements move relative to one another along their contact surface, thereby changing the overall height of the arrangement. According to one embodiment, the spacing can be varied by means of a hydraulic cylinder.

CN 202114508 U shows a height-adjustable supporting unit. This comprises a base, an adjusting block and a nut. The adjusting block and the nut are provided with internal threads and are screwed onto an external thread on a shaft of the base. The overall height of the unit can be varied by screwing and unscrewing.

In view of the prior art indicated, there is still room for improvement in the provision of an injector which is optimized as regards the injection process, especially in respect of the nozzle tip protrusion.

It is the underlying object of the present disclosure to optimize the injection process of an injector in an internal combustion engine, e.g. a diesel engine.

According to the present disclosure, the object is achieved by an injector arrangement for an internal combustion engine, comprising: an injector at least partially arranged in a cylinder head; a nozzle tip coupled to the injector and arranged at an end of the injector in an axial direction; and an actuator configured to vary a position of the nozzle tip relative to the cylinder head in the axial direction, with a minimum position and a maximum position of the nozzle tip set by the actuator.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-4 are shown to scale, though other relative dimensions may be used.

DETAILED DESCRIPTION

Figure 1:
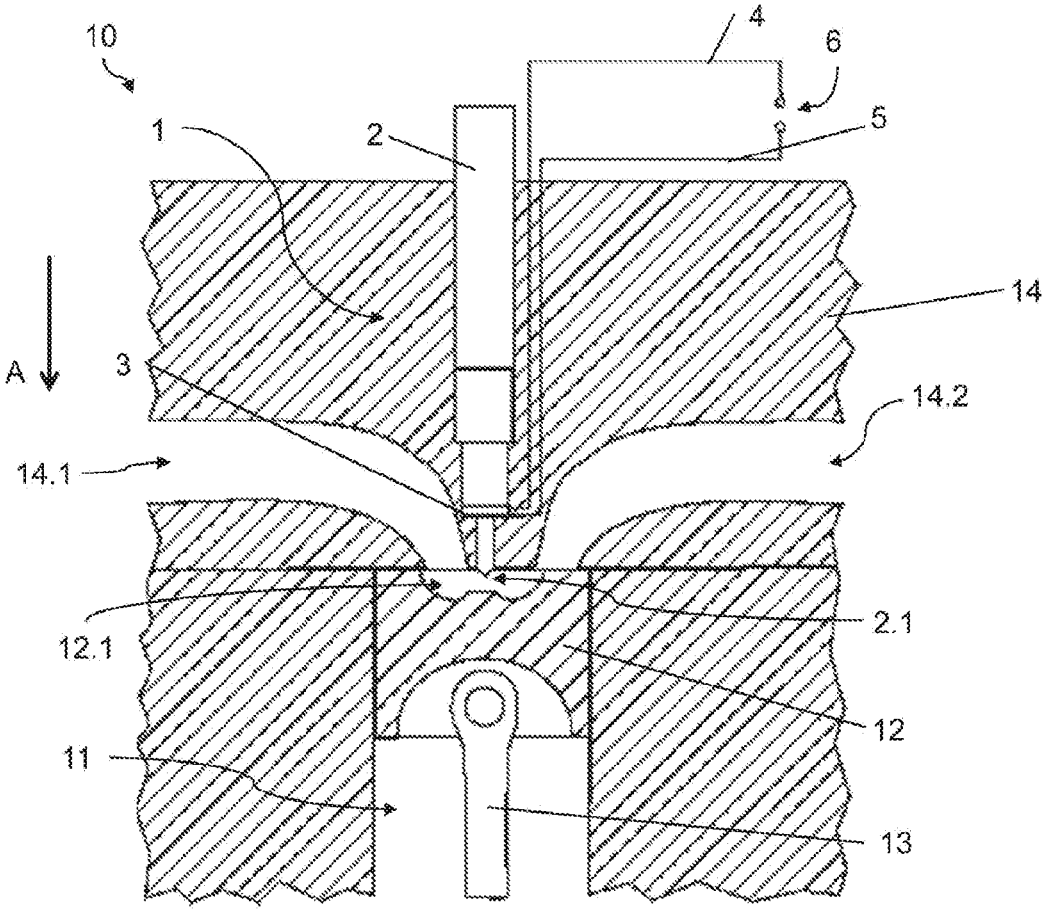
FIG. 1 shows a partial section of an engine including a fuel injector arrangement in a first position.

In the various figures, parts that are equivalent in terms of their functioning are always provided with the same reference signs, and they are therefore also generally described only once.

The present disclosure makes available an injector arrangement for an internal combustion engine, e.g. a diesel engine. In particular, this can be a diesel engine for a motor vehicle such as a heavy goods vehicle or passenger vehicle. Of course, the internal combustion engine can also be a spark ignition engine. The term "arrangement" normally means that this comprises a plurality of parts, although these may be connected permanently to one another. The injector arrangement has an injector for at least partial arrangement in a cylinder head of the internal combustion engine, e.g. the diesel engine. That is to say, the injector is mounted in a correspondingly designed recess in the cylinder head. Parts of the injector can project from the cylinder head on a side facing the cylinder and/or a side facing away from the cylinder. Of course, the injector, which can also be referred to as an injection nozzle, is used for injecting fuel into a cylinder of the internal combustion engine, e.g. the diesel engine, i.e. it has a connection for a fuel line and a valve, by means of which the injection process can be controlled. As regards the type of injection control, there are fundamentally no restrictions in the context of the present disclosure. That is to say, the valve can be opened by means of a pressure pulse from a pump associated with the injector, for example, or alternatively electromagnetically.

The injector has a nozzle tip arranged at the end in an axial direction. This nozzle tip forms, as it were, the end of the injector which is oriented toward the cylinder in the installed state and may also project into said cylinder. The term "axial direction" should not be interpreted to mean that the injector or parts thereof necessarily exhibit (axial) symmetry with respect to this direction, even if this can apply to parts of the injector. Of course, the axial direction points toward the cylinder in the installed state. Of course, the injector can be arranged with its axis oblique to the cylinder axis, this being possible in the case of a multi-valve concept, i.e. with a two-valve concept for example, wherein the axial direction in the sense according to the present disclosure points toward the cylinder in the installed state in this embodiment too. The nozzle tip has openings through which the fuel is introduced, that is to say injected for example, from the injector into the cylinder.

According to the present disclosure, the injector arrangement has an actuator, by means of which a position of the nozzle tip relative to the cylinder head can be varied in the axial direction. By means of said actuator, the nozzle tip protrusion can be varied in the installed state since the cylinder head and the cylinder are installed so as to be stationary relative to one another. It is thus possible to adapt the protrusion by means of the actuator, depending on the instantaneous requirements. Thus, at full load, for example, a shorter nozzle tip protrusion can be set than at partial load. In this case, the changes can be made, as it were, dynamically during the operation of the internal combustion engine, e.g. the diesel engine. Depending on the type and speed of the actuator, it is also possible to vary the position of the nozzle tip within a cylinder cycle.

The efficiency of the combustion process is determined by optimum mixture preparation, which, on the one hand, is achieved in terms of the air involved by means of appropriate inlet ports and piston recess geometries and, on the other hand, in terms of the fuel involved by means of optimum introduction of the fuel through appropriate injection nozzle configuration. By means of the present disclosure, the penetration depth (nozzle tip protrusion) of the injection nozzle is adjusted continuously to allow optimum adaptation in accordance with the operating point. Thus, by means of the present disclosure, longer or shorter nozzle tip protrusions can be set, depending on the operating load, in order to achieve an optimum jet pattern in the combustion recess, wherein injection jets outside the recess (high HC, CO, soot figures) are also avoided.

The variability of the position of the nozzle tip explicitly includes the possibility that the position of other parts of the injector and, in particular, the position of the injector overall, can be varied. It is self-evident that the actuator can be controlled in a suitable manner by means of the engine control system. As regards the functioning of the actuator, there are fundamentally no restrictions, even if a number of preferred embodiments are discussed below. The actuator can be connected in a fixed manner to the injector and may even be integrated into the latter. As an alternative, however, it can also form a separate component resting on the injector, for example. There is also the possibility that the injector arrangement will have a plurality of actuators, even if a single actuator is sufficient.

Since it is desirable that it should be possible to set the position of the nozzle tip in a predetermined manner, it is possible according to the present disclosure optionally for a predetermined minimum position and a predetermined maximum position of the nozzle tip to be set by means of the actuator. The minimum and maximum positions represent the outermost positions of the movement of the nozzle tip. The nozzle tip can adopt at least these two positions in a defined manner, and it can be held in these positions. Of course, one of the positions corresponds to a minimum nozzle tip protrusion and the other corresponds to a maximum nozzle tip protrusion. Thus, for example, the minimum position can be provided for full load and the maximum position for partial load or vice versa.

Even if an improvement over the prior art can already be achieved through the possibility of setting two extreme positions, it is advantageous if at least one intermediate position between the minimum position and the maximum position can be set by means of the actuator. Finer matching of the nozzle tip protrusion is thereby possible, thereby allowing the combustion process to be made even more efficient. In particular, there is the possibility that a plurality of intermediate positions or even any desired intermediate position can be set. For the last mentioned case, in which therefore there is continuous adjustability, a multiplicity of different actuators is suitable (but not a stepper motor, for example).

As already explained, the change in position can affect just one part of the injector comprising the nozzle tip. It would thus be conceivable for some other part of the injector to remain stationary and for the injector, as it were, to expand or contract.

According to a preferred embodiment, the change in position affects the entire injector. It is preferred here that the injector arrangement comprise a spacer element for arrangement between the injector and the cylinder head, wherein an axial extent of the spacer element is adjustable by means of the actuator. Said spacer element can optionally be connected detachably or non-detachably to the injector, or it can be of separate construction and merely rest on the injector. Normally, the spacer element is arranged between the injector and the cylinder head in the axial direction. In each case, the change in the axial extent of the spacer element has the effect that the axial position of the injector relative to the cylinder head changes. The spacer element can consist of a single component or of a plurality of components. In principle, it is also conceivable for a plurality of spacer elements to be provided. According to one embodiment, shoulders extending at an angle to the axial direction and supported on one another with the spacer element in between are formed both on the injector and on the cylinder head.

To prevent tilting of the injector when the latter is moved by the spacer element, it is advantageous if the action of the force exerted by the spacer element is not one-sided but is more or less symmetrical. According to an advantageous embodiment, this is promoted by the fact that the spacer element is arranged tangentially around the injector. Here, the term "tangentially" should, of course, be understood in relation to the abovementioned axial direction. The spacer element can be arranged so that it surrounds the injector completely or partially, wherein it preferably occupies an angle of at least 180° around the injector. In particular, the spacer element can have a cross section in the form of a circular ring or a circular arc in this case. In principle, however, the cross section can also be oval or polygonal, for example. Particularly in cases in which the spacer element is arranged so as to extend all the way around, the injector can also be said to be passed through the spacer element. Formed within the spacer element is an aperture which corresponds at least to the outside dimensions of the injector. In this case, the injector can have a tapered region, which merges via a shoulder into a wider region, wherein the spacer element rests on the shoulder and completely or partially surrounds the tapered region.

The spacer element can optionally be embodied in a space-saving manner. According to one embodiment, the spacer element is flattened in the axial direction. This should be understood to mean that a dimension of the spacer element in the axial direction is smaller than the minimum dimension transversely to the axial direction. This configuration can be combined especially with the abovementioned encircling arrangement of the spacer element. In the case of a spacer element in the form of a circular ring, for example, the thickness thereof (in the axial direction) is less than the outside diameter thereof. Furthermore, the thickness can be less than the internal radius or, in general terms: it can be less than 50% of the minimum dimension transversely to the axial direction. The spacer element preferably extends in a plane transverse to the axial direction. In particular, it can have approximately the shape of a washer.

Although it is conceivable in principle that the spacer element and the actuator form components that are completely separate from one another, it is preferred if the spacer element at least partially comprises the actuator. That is to say at least part of the actuator is integrated into the spacer element, or it is even conceivable for there to be no physical separation between the actuator and the spacer element, i.e. the actuator (or optionally a part thereof) is formed by the spacer element, or the actuator forms the spacer element.

As regards the functioning of the actuator used, there are in principle no restrictions. Overall, preference is given to actuators by means of which it is possible to achieve a rapid response time. In particular, the response time should be significantly shorter than one cycle of the internal combustion engine (e.g., cylinder cycle), that is to say, for example, of the diesel engine, to enable the nozzle tip protrusion to be adapted during one cycle. It is preferred if the injector adjustment has a resolution on the cycle level, i.e. can be carried out within the millisecond range. The actuator can be designed as an electroactive polymer actuator (EAP actuator) or as an electric motor. In the latter case, it can be a linear motor, in particular. The electric motor can optionally also be designed as a stepper motor.

According to a preferred embodiment, the actuator is a piezoelectric actuator, i.e. a piezoelectric element. This can advantageously be combined with the embodiment in which a spacer element designed as a washer is provided. With such an actuator, it is possible to vary the axial extent of the spacer element in a particularly simple manner without the need for the actuator to comprise moving parts. The application of an electric voltage across a piezoelectric element has the effect that its extent changes, i.e. the piezoelectric element contracts or expands. It can be a multilayer piezoelectric element, for example, by means of which a greater expansion can be achieved for the same voltage. The response time of a piezoelectric actuator is sufficiently short to perform a plurality of adjustments during one cycle of the internal combustion engine, i.e. the diesel engine, for example. By means of an actuator of this kind, it is, of course, possible, through the choice of voltage, to vary the position of the nozzle tip or of the injector continuously, meaning that the nozzle tip protrusion can be varied continuously.

It is furthermore preferred here that the piezoelectric actuator be formed by the spacer element. That is to say that, in this case, there is absolutely no physical separation between the actuator and the spacer element; instead, a single component performs both functions. In this case, therefore, the piezoelectric actuator is arranged as a spacer element between the injector and the cylinder head, and the position of the injector is varied by varying the axial extent of said element, which can be adjusted by means of a power supply. In this case, the piezoelectric actuator can be in the form of a circular ring and have approximately the shape and dimensions of a washer, as already mentioned above. That is to say that, apart from the fact that supply leads for supplying power to the actuator must be provided, this embodiment can be integrated into existing systems particularly easily and without major adaptations. The actuator as it were exerts a pressure but no tension, and therefore the injector is actively raised but not lowered. Thus, in a preferred embodiment, a fastening device in the illustrative embodiment is provided as a "clamp", which is used for injector installation in the injector bore. One side of the clamping arrangement rests on the cylinder head, while the other side rests on the injector. The injector is appropriately "screwed in" by means of a central screw arrangement in the clamp, ensuring that the injector performs the appropriate movement, even in the case of a decreasing extent of the actuator in the form of a piezoelectric element-washer. Accordingly, the clamp is as it were a kind of return spring. In one possible embodiment, provision can be made for the actuator in the form of a piezoelectric element-washer to be fixed immovably, on the one hand at its contact location with the cylinder head and on the other hand at its contact location with the injector, with the result that, through the change in the extent of the piezoelectric element-washer, a corresponding adjustment of the nozzle tip protrusion is brought about by the relative movement. It is also conceivable for the injector to follow the changes in the extent of the piezoelectric element-washer under the action of gravity, especially when said washer contracts.

According to another possible embodiment, the actuator is a hydraulic actuator. In the operating state, an actuator of this kind is connected to a hydraulic feed, which is subjected to pressure by means of a pump. The actuator can operate in the manner of a hydraulic cylinder, wherein it can be of either single-acting or double-acting design. Whereas, in the former case, just one connection to the hydraulic feed is provided and the active movement of the actuator takes place in only one direction, two connections are provided in the latter case and active movement takes place in both directions. The latter can be preferred in order to provide a more rapid response time. In principle, it is possible with this embodiment too that the actuator simultaneously forms the spacer element. In principle, a hydraulic actuator of this kind can also surround the injector in the form of a circular ring. As an alternative, the actuator can optionally be a pneumatic actuator, even if better precision and a shorter response time can normally be achieved with a hydraulic actuator.

FIG. 1 shows a portion of an internal combustion engine 10. The internal combustion engine 10 is referred to below as diesel engine 10, although the internal combustion engine 10 can, of course, also be a spark ignition engine or a hybrid engine. At the same time, the illustration is highly schematized and simplified, with elements that are not relevant to the explanation of the present disclosure having been omitted.

FIG. 1 shows part of a cylinder 11 with a piston 12 arranged therein, which has an annular recess 12.1. The piston 12 is connected in an articulated fashion to a connecting rod 13. The cylinder 11 is closed in a known manner by a cylinder head 14, through which there extend, inter alia, a gas passage 14.1 for fresh air leading to the cylinder 11 and a second gas passage 14.2 for exhaust gases leading away from the cylinder 11. For reasons of clarity, hydraulic tappets, which can close the gas passages 14.1, 14.2, and other details of the cylinder head 14 are not shown.

An injector 2, which is part of an injector arrangement 1 according to the present disclosure, is inserted into the cylinder head 14. In the present case, the injector 2 does not differ from injectors known in the prior art. It is not shown sectioned since the details of its internal construction are of no particular significance in the context of the present disclosure. The injector 2 is of very largely symmetrical design relative to a longitudinal axis extending in an axial direction A. At the end in the axial direction A, the injector 2 has a nozzle tip 2.1, in which openings (not shown) for the injection of fuel into the region of the recess 12.1 are arranged. As can be seen, in particular, in the enlarged detail view in FIG. 2, the nozzle tip 2.1 projects slightly from the cylinder head 14 into the region of the cylinder 11. The distance by which the nozzle tip 2.1 projects into the cylinder 11 is referred to as the nozzle tip protrusion V.

This nozzle tip protrusion V, which is connected to an axial position of the injector 2, is determined inter alia by an actuator 3, which is arranged between the cylinder head 14 and the injector 2.

Figure 2:
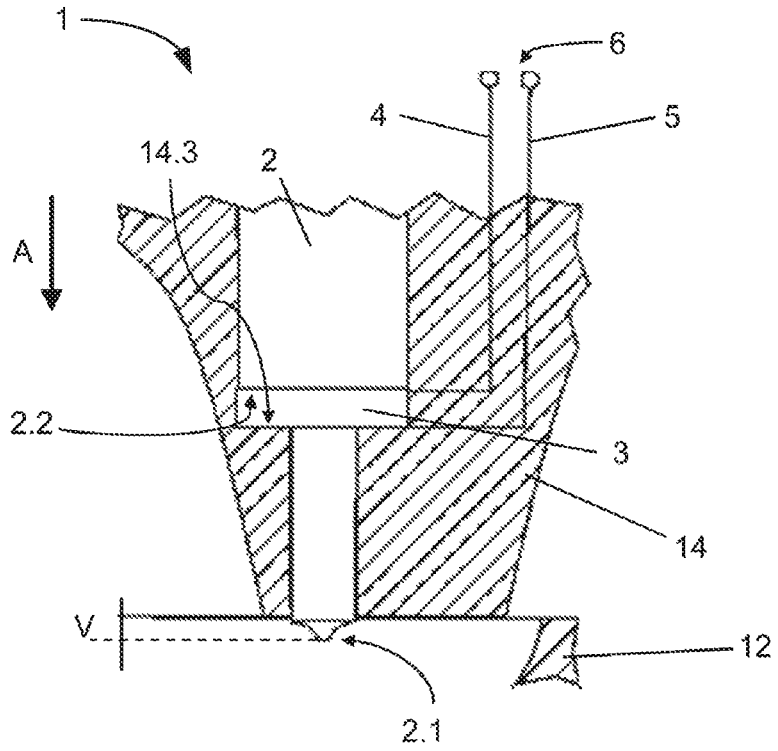
FIG. 2 shows an enlarged view of the fuel injector arrangement.
Figure 3:
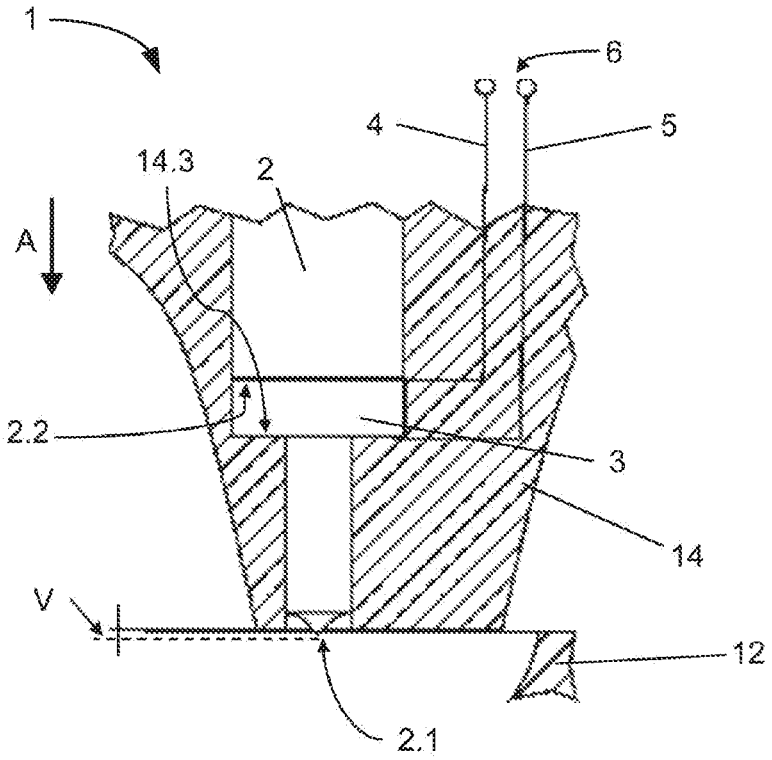
FIG. 3 shows an enlarged view of the fuel injector arrangement, with the fuel injector arrangement in a second position.
Figure 4:
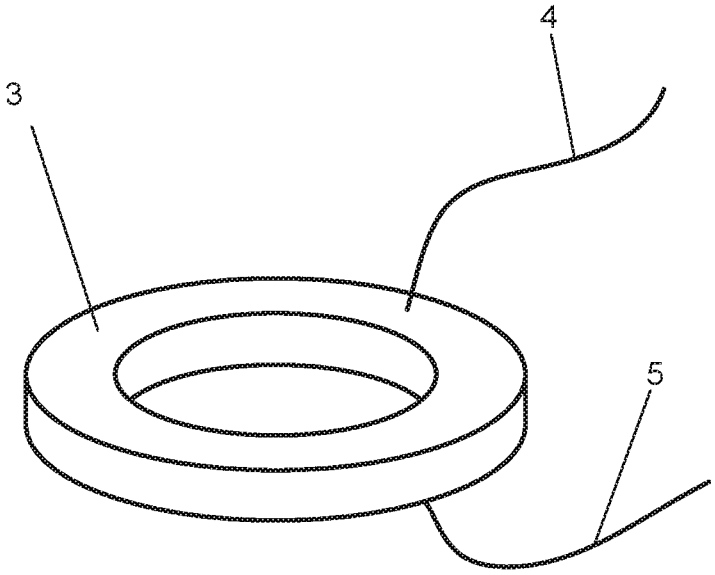
FIG. 4 shows a perspective view of an actuator of the fuel injector arrangement.

As a spacer element, the actuator 3 essentially has the shape of a washer, as can be seen in the perspective illustration in FIG. 4. In FIGS. 1-3, the actuator 3 is likewise not shown sectioned. Formed on the injector 2 is a shoulder 2.2, which is supported on the actuator 3 which, for its part, is supported in turn on an opposite shoulder 14.3 of the cylinder head 14.

The actuator 3 is likewise part of the injector arrangement 1 and is embodied as a piezoelectric element-washer. The actuator 3 is connected to a power source 6 by leads 4, 5. The leads 4, 5 are connected to ends of the actuator 3 which lie opposite one another in axial direction A. Thus, a voltage between the two leads 4, 5 brings about an expansion of the actuator 3, i.e. of the piezoelectric element-washer, in the axial direction A. It is self-evident that the path of the leads 4, 5 which is shown in FIGS. 1-4 is to be taken as being purely schematic and that it differs from the real path. The power source 6 can be regulated by an engine control system (not shown).

FIGS. 1-2 show the actuator 3, i.e. the piezoelectric element-washer, with the minimum possible axial extent, which corresponds to a maximum nozzle tip protrusion V. In this state, no voltage is being applied across the actuator 3 by the power source 6. In contrast, FIG. 3 shows a state in which a maximum envisaged voltage is being applied across the actuator 3, as a result of which the actuator expands in axial direction A. As a result, in turn, the injector 2 moves away from the cylinder 11 and there is a significantly smaller nozzle tip protrusion V.

As can be seen, the actuator 3, which can also be referred to as a piezoelectric actuator, is formed by the spacer element. That is to say that, in this case, there is no physical separation between the actuator 3 and the spacer element; instead, a single component performs both functions. In this case, therefore, the piezoelectric actuator 3 is arranged as a spacer element between the injector and the cylinder head and the position of the injector is varied by varying the axial extent of said element, which can be adjusted by means of a power supply. In this case, the piezoelectric actuator 3 can be in the form of a circular ring and have approximately the shape and dimensions of a washer, as already mentioned above. That is to say that, apart from the fact that supply leads for the power supply to the actuator must be provided, this embodiment can be integrated into existing systems particularly easily and without major adaptations.

While FIGS. 2-3 show the extreme positions of the injector 2, it is in principle possible to set all conceivable intermediate positions by varying the voltage. By virtue of the rapid response time of the piezoelectric actuator 3, the respective position can be set several times during one cycle (e.g., cylinder cycle) of the internal combustion engine, e.g. of the diesel engine 10, if required.

FIGS. 1-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 5:
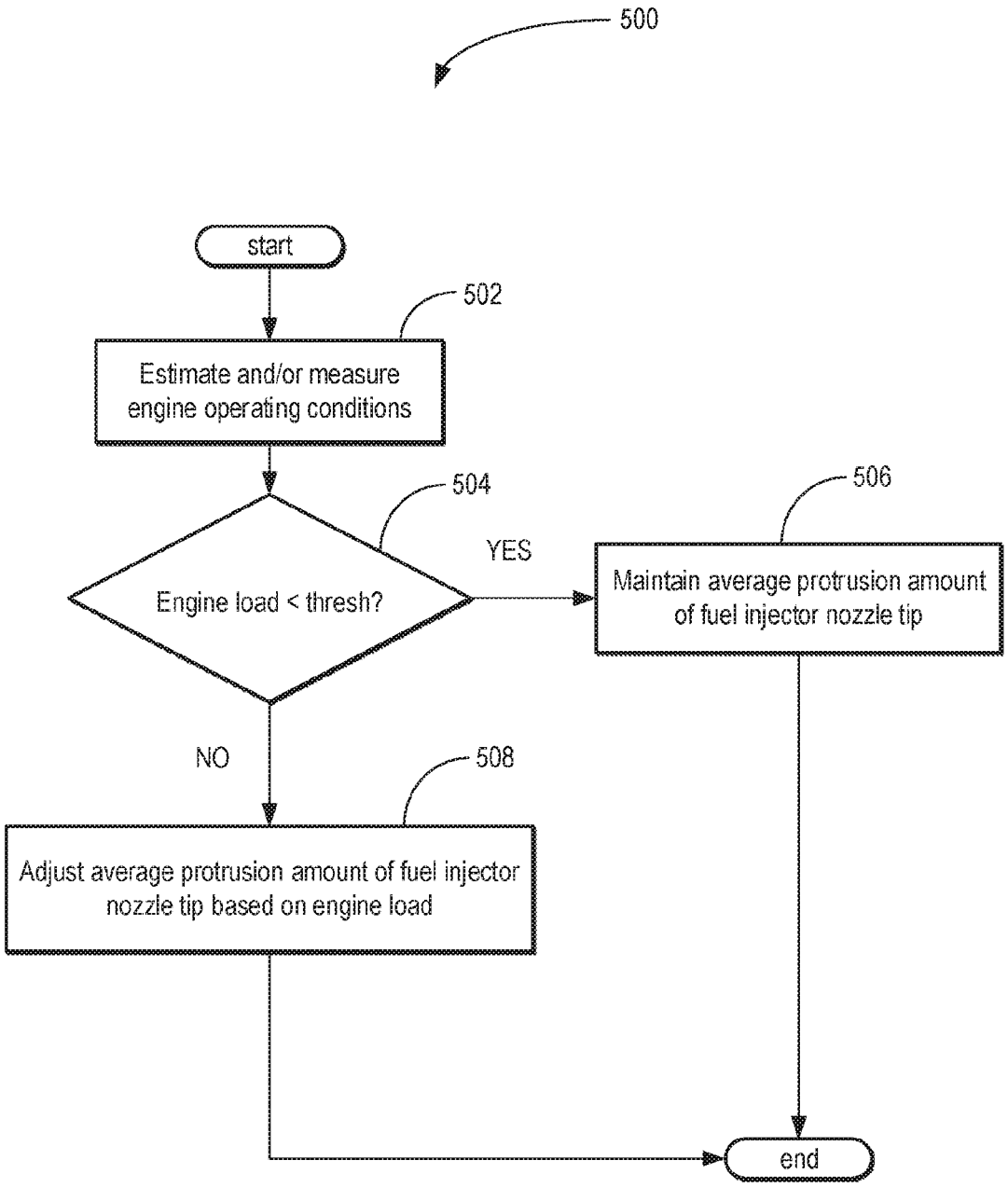
FIG. 5 illustrates an example method for adjusting a position of a fuel injector in response to engine operating conditions.

FIG. 5 shows an example method of adjusting a position of a fuel injector (such as the injector 2 shown by FIGS. 1-3 and described above) in response to engine operating conditions. In one embodiment, adjusting the position of the fuel injector includes adjusting an amount of energization of a piezoelectric actuator (such as the piezoelectric actuator 3 shown by FIGS. 1-3 and described above), with the piezoelectric actuator positioned between the fuel injector and a cylinder head of the engine.

For example, the piezoelectric actuator may be a ring-shaped actuator, as described above with reference to FIGS. 1-3, and may be positioned between a shoulder of the injector (such as shoulder 2.2 shown by FIGS. 2-3) proximate to a nozzle of the injector and a shoulder of the cylinder head (such as opposite shoulder 14.3 of the cylinder head 14, shown by FIGS. 2-3) in an axial direction of the injector (e.g., axial direction A shown by FIGS. 1-3). The piezoelectric actuator may be energized in order to expand the piezoelectric actuator in the axial direction, thereby increasing a distance between the shoulder of the injector and the shoulder of the cylinder head. Similarly, when an amount of energization of the piezoelectric actuator is decreased, the piezoelectric actuator may contract in the axial direction, thereby decreasing the distance between the shoulder of the injector and the shoulder of the cylinder head. By increasing or decreasing the distance between the shoulder of the injector and the shoulder of the cylinder head, a protrusion amount of a nozzle tip (e.g., nozzle tip 2.1 shown by FIGS. 2-3) of the injector from the cylinder head and into a combustion chamber (e.g., cylinder 11 shown by FIG. 1) is adjusted.

In another embodiment, adjusting the position of the fuel injector in response to engine operating conditions includes adjusting a fluid pressure of a hydraulic actuator or pneumatic actuator positioned between the fuel injector and the cylinder head (e.g., between the shoulder of the injector and the shoulder of the cylinder head as described above). For example, increasing a distance between the shoulder of the fuel injector and the shoulder of the cylinder head may include increasing a fluid pressure of the hydraulic actuator or pneumatic actuator, while decreasing the distance between the shoulder of the fuel injector and the shoulder of the cylinder head may include decreasing the fluid pressure of the hydraulic actuator or pneumatic actuator.

Instructions for carrying out method 500 and the rest of the methods included herein may be executed by a controller based on instructions stored on a memory of the controller and in conjunction with signals received from sensors of the engine system, such as engine speed sensors, temperature sensors, crankshaft position sensors, etc. The controller may employ engine actuators of the engine system to adjust engine operation, according to the methods described below.

Method 500 includes estimating and/or measuring engine operating conditions at 502 based on one or more outputs of various sensors in the engine system and/or operating conditions of the engine system (e.g., such as various temperature sensors, pressure sensors, etc., as described above). Engine operating conditions may include engine speed and load, rate of engine load increase, fuel pressure, pedal position, fuel injector nozzle opening times, mass air flow rate, turbine speed, compressor inlet pressure, emission control device temperature, etc. Estimating and/or measuring engine operating conditions may also include estimating and/or measuring an amount of protrusion of each fuel injector nozzle tip into each corresponding cylinder. In one example, the amount of protrusion may be based on an amount of energization of a corresponding piezoelectric actuator coupled between each fuel injector and the cylinder head (as described above).

At 504, the method includes determining whether the engine load is below a threshold engine load. For example, the controller may compare an estimated and/or measured value for engine load (determined by the controller based on an output from one or more sensors, as described above) to the threshold engine load in order to determine whether the estimated and/or measured engine load is less than the threshold engine load. In one example, the threshold engine load may be based on an amount of engine load at which a maximum protrusion of the nozzle tip of the fuel injector into the corresponding cylinder is desireable. For example, for engine loads below the threshold engine load, the maximum protrusion of the nozzle tip may increase a combustion efficiency of the cylinder by increasing a mixing of air and fuel within the cylinder.

If the engine load is below the threshold engine load at 504, the method continues to 506 where the method includes maintaining an average protrusion amount of the fuel injector nozzle tip. For example, the average protrusion amount may be determined by the controller over one full combustion cycle of the cylinder (e.g., one cycle including intake stroke, compression stroke, power stroke, and exhaust stroke) immediately prior to 506. The intake stroke, compression stroke, power stroke, and exhaust stroke may be referred to collectively herein as a cylinder cycle, combustion cycle, or engine cycle. In one example, the controller may maintain the average amount of protrusion throughout each stroke such that the nozzle tip protrudes into the cylinder by an equal amount during each of the intake stroke, compression stroke, power stroke, and exhaust stroke. In another example, the controller may maintain the average amount of protrusion throughout the combustion cycle, but the amount of protrusion during one or more strokes may differ from the amount of protrusion during each other stroke. For example, during the intake and compression strokes, the amount of protrusion of the nozzle tip may be greater than the amount of protrusion during the power and exhaust strokes. However, the controller may average the amount of protrusion over each of the four strokes, and the averaged amount may be maintained.

If the engine load is not below the threshold engine load at 504, the method continues to 508 where the method includes adjusting the average protrusion amount of the fuel injector nozzle tip based on engine load. For example, as described above with reference to 506, the controller may average the amount of protrusion of the nozzle tip throughout the intake stroke, compression stroke, power stroke, and exhaust stroke. In response to the estimated and/or measured engine load, the average amount of protrusion may be increased or decreased. In one example, as engine load increases, the average amount of protrusion may be decreased. Similarly, as engine load decreases (but is still greater than the threshold engine load), the average amount of protrusion may increase.

By adjusting the average protrusion amount of the fuel injector nozzle tip into the cylinder in response to the measured and/or estimated engine load, combustion quality may be increased. For example, as engine load increases, a compression ratio of the cylinders may also increase. By decreasing the average amount of protrusion in response to the increased engine load, a fuel injection path from the nozzle tip may be optimized and a mixing of fuel and air may be increased. Additionally, by decreasing the average amount of protrusion in response to the increased engine load, a formation of carbon deposits on the nozzle tip may be reduced due to a decreased amount of exposure of the nozzle tip to high cylinder temperatures.

In another example, by increasing the average amount of protrusion of the nozzle tip in response to decreased engine load, an amount of electric energy supplied to the piezoelectric actuator may be reduced. In other words, as described above, the protrusion amount of the nozzle tip is decreased when the energization of the piezoelectric actuator is increased. In order to increase the average amount of protrusion, the amount of energization of the piezoelectric actuator is decreased. As engine load decreases, the amount of energy supplied to the piezoelectric actuator is also decreased, and the average amount of protrusion of the nozzle tip is increased. By adjusting the protrusion of the nozzle tip in this way, a smaller amount of energy may be expended by an electrical power source of the engine (e.g., a battery) as engine load decreases.

In one example, the average protrusion amount may be determined by the controller over one full combustion cycle of the cylinder (e.g., one cycle including intake stroke, compression stroke, power stroke, and exhaust stroke) immediately prior to 508. In some examples, the controller may adjust (e.g., increase or decrease) the average amount of protrusion by an equal amount for each of the intake stroke, compression stroke, power stroke, and exhaust stroke. In other examples, the controller may adjust the average amount of protrusion by increasing or decreasing the amount of protrusion during one or more strokes, such that the amount of protrusion during the one or more strokes may differ from the amount of protrusion during each other stroke. For example, during the intake and compression strokes, the amount of protrusion of the nozzle tip may be increased relative to the amount of protrusion during the power and exhaust strokes. In this way, the average the amount of protrusion over each of the four strokes may be increased.

While the method 500 is described above with reference to an example fuel injector of the engine, method 500 may be carried out by the controller for one or more fuel injectors of the engine. In one example, the controller may execute method 500 for each fuel injector of the engine. In another example, the controller may execute method 500 for only some fuel injectors of the engine and not others.

Figure 6:
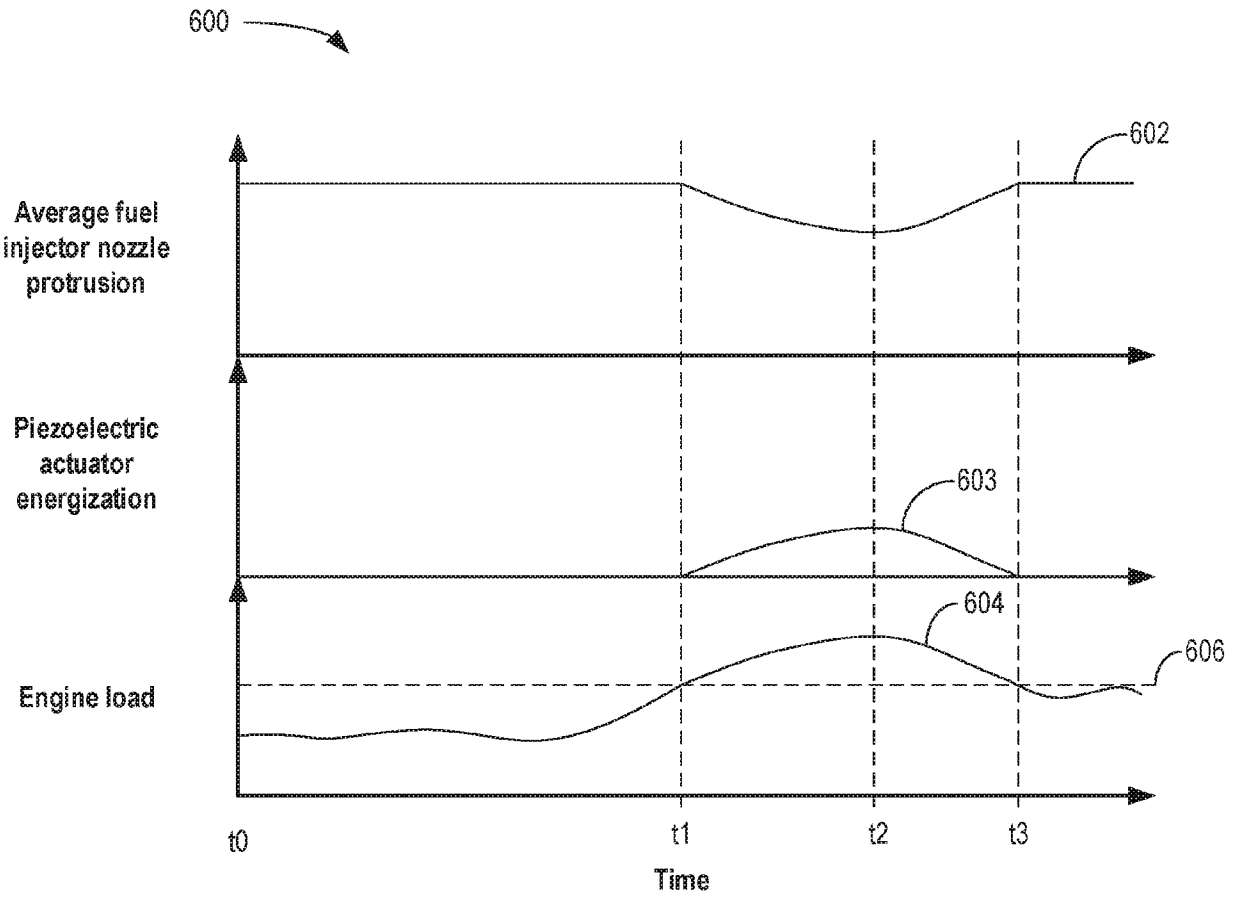
FIG. 6 shows an example of adjustments to average fuel injector nozzle protrusion based on engine load.

FIG. 6 shows an example of adjustments to average fuel injector nozzle protrusion based on engine load in accordance with the method 500 shown by FIG. 5. Plot 600 shows an averaged amount of fuel injector nozzle protrusion at 602 (as determined by the controller, described above with reference to method 500 of FIG. 5), a measured and/or estimated engine load at 604, an energization amount of a piezoelectric actuator at 603 (e.g., piezoelectric actuator 3 shown by FIGS. 1-4), and a threshold engine load at 606. In one example, the threshold engine load at 606 is the threshold engine load described above with reference to 504 shown by FIG. 5.

Between time t0 and time t1, the engine load at 604 fluctuates slightly, but is below the threshold engine load 606. As a result, the average fuel injector nozzle protrusion at 602 is maintained at a constant amount. Additionally, the energization of the piezoelectric actuator is also maintained at a constant amount. In the example shown by FIG. 6, between time t0 and t1, the amount of energization of the piezoelectric actuator is approximately zero. In other words, the piezoelectric actuator is not energized.

At time t1, the engine load at 604 has increased by an amount such that the engine load is greater than the threshold engine load at 606. In response to the engine load exceeding the threshold engine load, the piezoelectric actuator is energized as shown by 603, and the average fuel injector nozzle protrusion amount decreases as shown by 602.

Between time t1 and t2, the engine load at 604 increases and reaches a peak at time t2. As the engine load increases, the energization of the piezoelectric actuator also increases at 603, thereby decreasing the average fuel injector nozzle protrusion amount at 602.

At time t2, engine load at 604 begins to decrease. Accordingly, energization of the piezoelectric actuator also begins to decrease at 603, and the average fuel injector nozzle protrusion begins to increase at 602.

Between time t2 and t3, the engine load continues to decrease at 604, the energization of the piezoelectric actuator continues to decrease at 603, and the average fuel injector nozzle protrusion continues to increase at 602.

At time t3, the engine load at 604 decreases below the threshold engine load 606. As a result, the energization of the piezoelectric actuator at 603 decreases, and the piezoelectric actuator is de-energized. The average fuel injector nozzle protrusion at 602 no longer increases and is instead maintained at a constant amount (e.g., an amount corresponding to a maximum amount of protrusion of the nozzle tip).

After time t3, the engine load at 604 does not increase above the threshold engine load at 606. As a result, the average fuel injector nozzle protrusion at 602 is maintained at the constant amount, and the energization of the piezoelectric actuator is also maintained at a constant amount (e.g., zero energization, in this example).

While the example shown by FIG. 6 includes adjustments to fuel injector position in response to engine load, alternate embodiments may include adjustments to fuel injector position (e.g., amount of nozzle tip protrusion) in response to a different condition. For example, in one embodiment, the amount of nozzle tip protrusion may be adjusted in response to a pressure of fuel within fuel lines coupled to the fuel injector. In another embodiment, the amount of nozzle tip protrusion may be adjusted in response to an amount of intake valve and exhaust valve overlap within the combustion cycle. In yet other embodiments, the amount of nozzle tip protrusion may be adjusted in response to one or more conditions, such as a combination of fuel pressure and valve overlap, or a different combination of conditions.

FIGS. 7A-7D each show example adjustments to fuel injector nozzle protrusion based on engine operating conditions. In one example, the adjustments shown by FIGS. 7A-7D may be performed in response to engine load, as described above with reference to FIGS. 5-6. In another example, an amount of engine load may be a same amount in each of the adjustments shown by FIGS. 7A-7D, with the adjustments performed in response to a different condition, such as an estimated and/or measured amount of engine knock, fuel injector nozzle temperature, fuel line pressure, etc. For example, although engine load may be a same amount in each of the examples shown by FIGS. 7A-7D, the controller may perform any of the adjustments shown by FIGS. 7A-7D in order to reduce fuel injector nozzle temperature, reduce engine knock, etc., thereby increasing engine performance.

In each of the examples shown by FIGS. 7A-7D, a full combustion cycle of the engine is shown, including an intake stroke, compression stroke, power stroke, and exhaust stroke. While the examples shown by FIGS. 7A-7D show a combustion cycle of a diesel engine, the adjustments to nozzle protrusion shown by FIGS. 7A-7D may also apply to spark ignition engines. Top-dead-center piston position is indicated as TDC, while bottom-dead-center piston position is indicated by BDC. During the intake stroke, fresh air flows into the cylinder (e.g., cylinder 11 shown by FIG. 11) via an intake passage coupled with the cylinder. The fresh air is compressed by a movement of the piston from BDC to TDC during the compression stroke, and fuel is injected into the cylinder (as described below). The fuel and air mix and ignite, and the resulting ignition pushes the piston from TDC to BDC during the power stroke. The burned air/fuel mixture is then expelled from the cylinder as exhaust gas during the exhaust stroke via an exhaust passage coupled with the cylinder.

As shown in each of FIGS. 7A-7D, fuel may be injected into the cylinder during the end of the compression stroke and immediately prior to the power stroke, as indicated by main injection 704. A smaller amount of fuel may also be injected into the cylinder at different times in what is known as a pilot injection, as shown by first pilot injection 700 and second pilot injection 702. In the examples shown by FIGS. 7A-7D, first pilot injection 700 occurs approximately halfway through the intake stroke, while second pilot injection 702 occurs near the start of the compression stroke and before the main injection 704. In other examples, the main injection 704, first pilot injection 700, and second pilot injection 702 may occur at times different than those shown by FIGS. 7A-7D. Additionally, other examples may include a different number of pilot injections, such as one, three, four, etc. Accordingly, the adjustments described below with reference to FIGS. 7A-7D may be adapted for different numbers and/or timings of pilot injections as well as different timings of the main injection. In some examples, the pilot injections (e.g., first pilot injection 700 and second pilot injection 702) may increase a combustion stability of the engine (e.g., decrease a likelihood of a misfire). Each pilot injection injects a smaller amount of fuel into the cylinder than the main injection 704, as indicated by the decreased duration of fuel injector nozzle opening of the pilot injections relative to the main injection. In other words, during the main injection 704, the fuel nozzle is opened for a longer amount of time than during either of the first pilot injection 700 or second pilot injection 702, thereby delivering an increased amount of fuel into the cylinder.

Figure 7A:
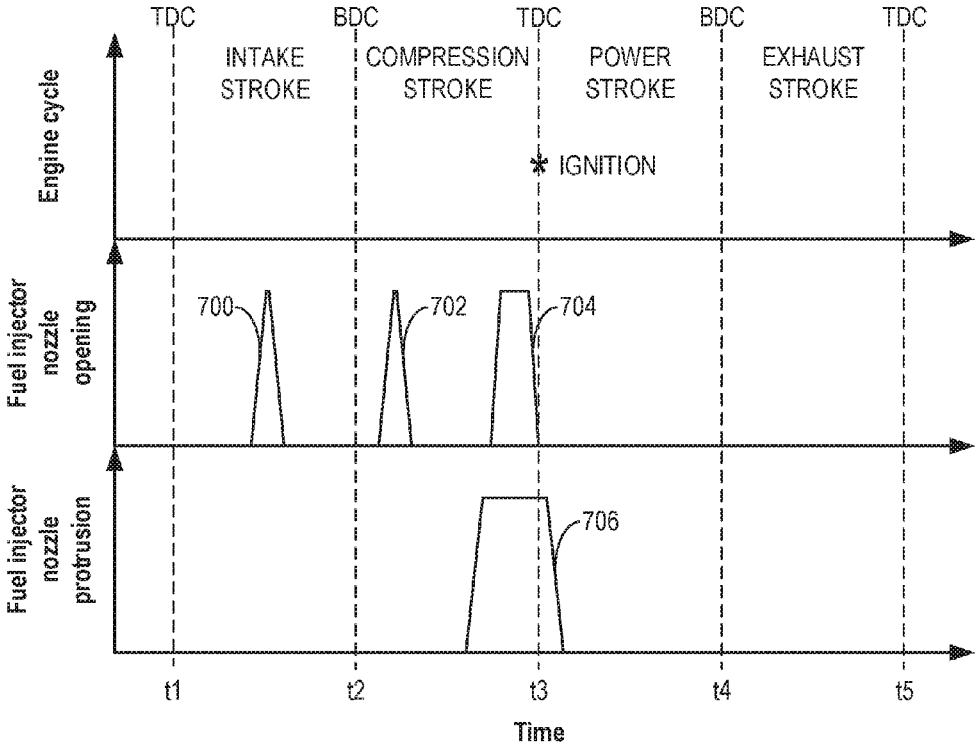
FIGS. 7A-7D each show example adjustments to fuel injector nozzle protrusion based on engine operating conditions.

In one example as shown by FIG. 7A, the controller may increase the amount of protrusion of the fuel injector nozzle tip (e.g., via energization of a piezoelectric actuator, such as piezoelectric actuator 3 shown by FIGS. 1-4) prior to the main injection 704 and may decrease the amount of protrusion of the fuel injector nozzle tip after the main injection 704, such that the nozzle tip protrudes by a greater amount during the main injection 704 than during either of the first pilot injection 700 or second pilot injection 702, as indicated at 706. Additionally, in this example, the amount of nozzle tip protrusion is not adjusted during either of the intake stroke or exhaust stroke. In alternate examples, the amount of nozzle tip protrusion may only be adjusted during the compression stroke, and may not be adjusted during each of the intake stroke, power stroke, and exhaust stroke, such that the nozzle tip protrudes by the increased amount during the main injection 704 but does not protrude by the increased amount at other times. In other examples, the nozzle may only protrude during the first pilot injection 700, during the second pilot injection 702, or only during a combination of one or more of the first pilot injection 700, the second pilot injection 702, and the main injection 704.

Figure 7B:
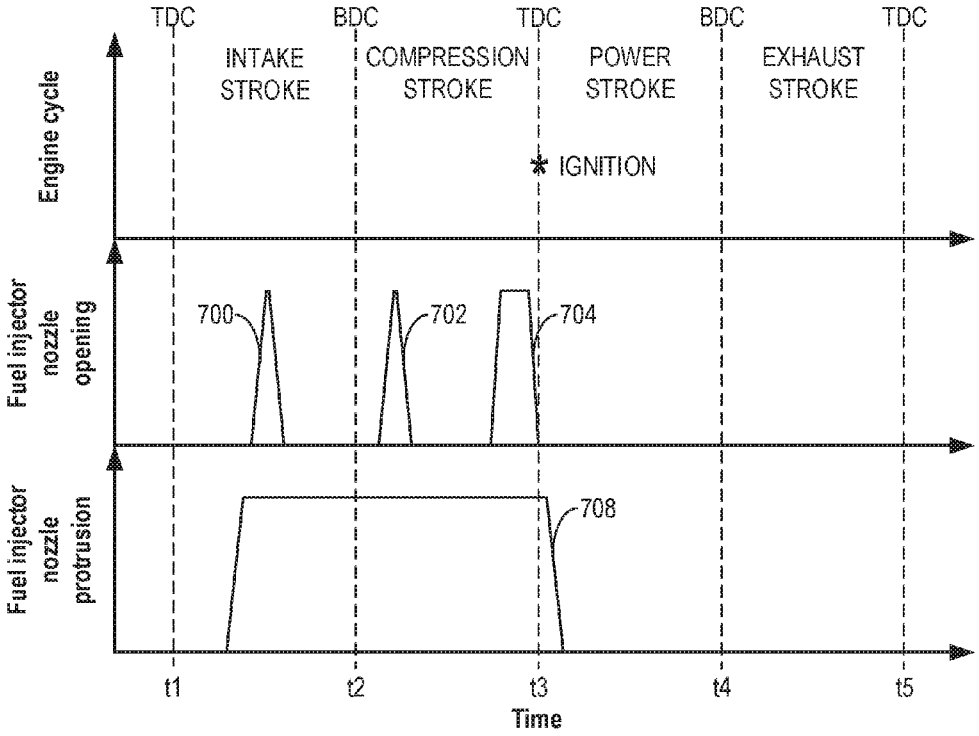

In another example as shown by FIG. 7B, the controller may increase the amount of protrusion of the fuel injector nozzle tip prior to the first pilot injection 700 and may decrease the amount of protrusion of the fuel injector nozzle tip after the main injection 704, such that the nozzle tip protrudes by a greater amount during an amount of time from the start of the first pilot injection 700 to the end of the main injection 704, as indicated at 708. Additionally, in this example, the amount of nozzle tip protrusion is not adjusted during the exhaust stroke, such that the nozzle tip protrudes by the increased amount during the first pilot injection 700, the second pilot injection 702, the main injection 704, and the full amount of time between the first pilot injection 700 and main injection 704, but does not protrude by the increased amount at other times.

Figure 7C:
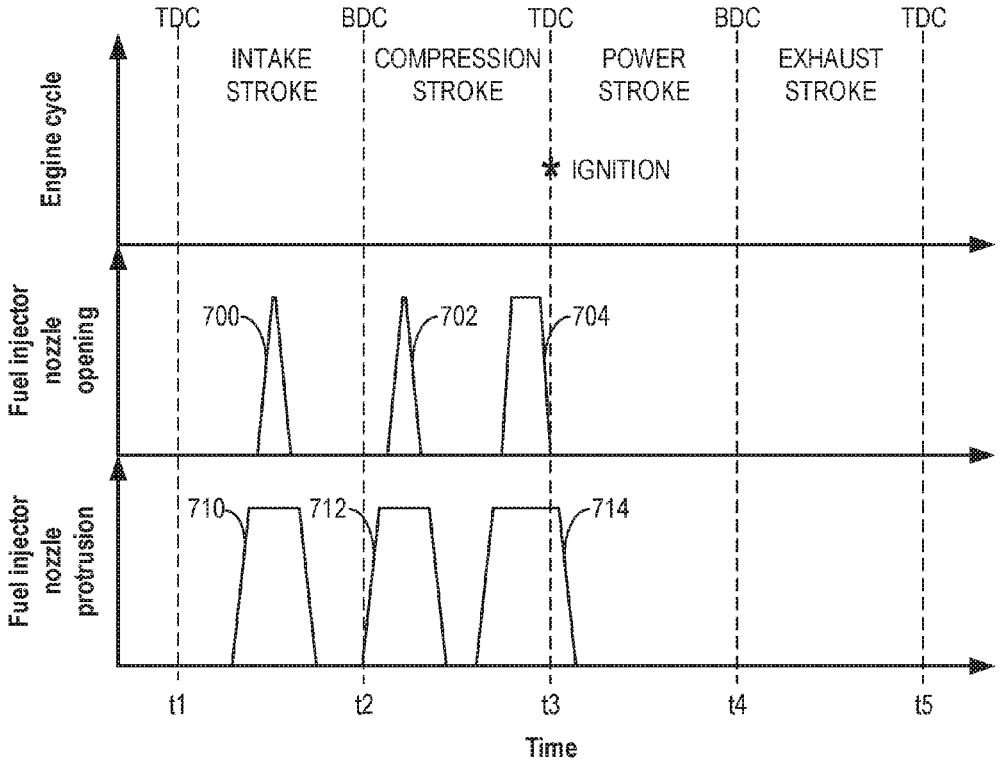

In another example as shown by FIG. 7C, the controller may increase the amount of protrusion of the fuel injector nozzle tip prior to the first pilot injection 700, may decrease the amount of protrusion of the fuel injector nozzle tip after the first pilot injection 700, may increase the amount of protrusion of the fuel injector nozzle tip prior to the second pilot injection 702, may decrease the amount of protrusion of the fuel injector nozzle tip after the second pilot injection 702, may increase the amount of protrusion of the fuel injector nozzle tip prior to the main injection 704, and may decrease the amount of protrusion of the fuel injector nozzle tip after the main injection 704. In other words, the injector nozzle tip may protrude by the increased amount during the first pilot injection 700 (as indicated at 710), second pilot injection 702 (as indicated at 712), and main injection 704 (as indicated at 714), but may not protrude by the increased amount at other times, including those times between the first pilot injection 700 and the second pilot injection 702, between the second pilot injection 702 and the main injection 704, and between the main injection 704 and the next first pilot injection 700 (e.g., the next pilot injection of the next combustion cycle). In this example, the amount of nozzle tip protrusion is not adjusted during the exhaust stroke.

Figure 7D:
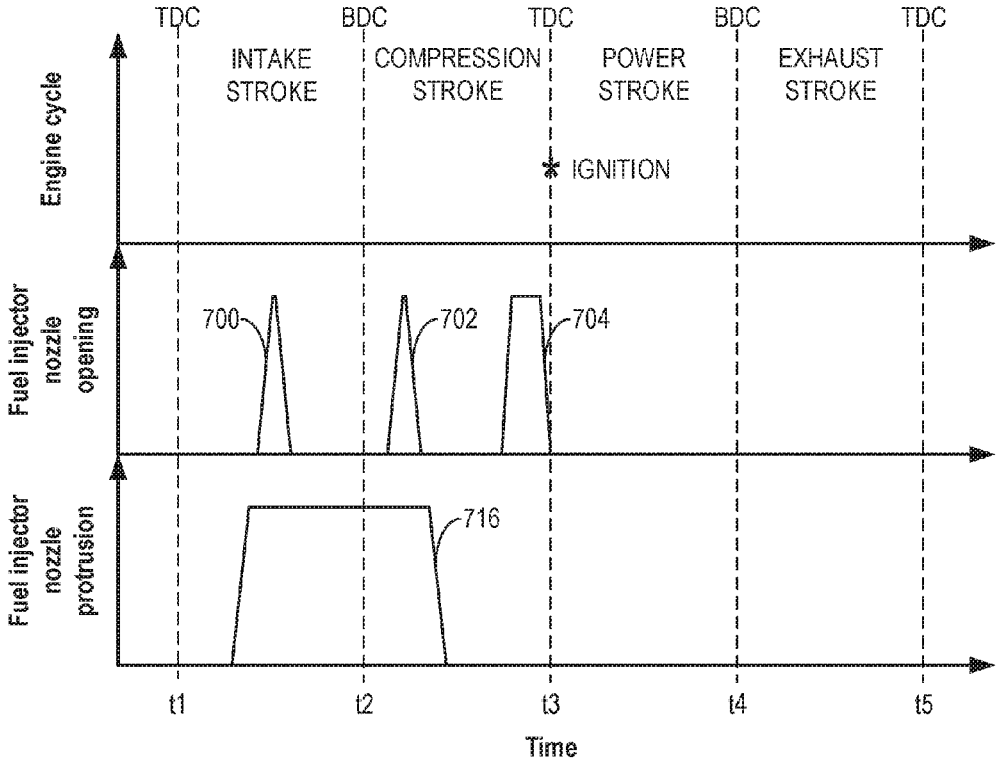

In another example as shown by FIG. 7D, the controller may increase the amount of protrusion of the fuel injector nozzle tip prior to the first pilot injection 700 and may decrease the amount of protrusion of the fuel injector nozzle tip after the second pilot injection 702 as indicated at 716, but may not adjust the amount of protrusion of the nozzle tip at other times. In other words, the injector nozzle tip may protrude by the increased amount during the first pilot injection 700, the second pilot injection 702, and the time between the first pilot injection 700 and the second pilot injection 702, but may not protrude by the increased amount during the main injection 704. In this example, the amount of nozzle tip protrusion is not adjusted during the power stroke or the exhaust stroke. In alternate examples, the injector nozzle tip may protrude by the increased amount during the second pilot injection 702, the main injection 704, and the time between the second pilot injection 702 and the main injection 704, but may not protrude by the increased amount during the first pilot injection 700.

By adjusting the protrusion of the fuel injector nozzle tip, the nozzle tip may have an increased amount of protrusion during fuel injection, and may have a decreased amount of protrusion between fuel injections. In this way, the piezoelectric actuator may be energized for a reduced amount of time, thereby reducing a load on electric components of the engine (e.g., a battery). Additionally, the increased protrusion of the nozzle tip may selectively coincide with pilot injections, the main injection, or a combination of pilot injections and the main injection in order to increase engine performance (e.g., reduce knock, reduce nozzle tip temperature, etc.)

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An injector arrangement for an internal combustion engine, comprising:

an injector at least partially arranged in a cylinder head, the injector comprising a tapered region which merges via a shoulder into a wider region;

a nozzle tip coupled to the injector and arranged at an end of the tapered region of the injector in an axial direction; and an actuator configured to vary a position of the nozzle tip relative to the cylinder head in the axial direction, with a minimum position and a maximum position of the nozzle tip set by the actuator, wherein the actuator rests on the shoulder and at least partially surrounds the tapered region of the injector.

2. The injector arrangement of claim 1, wherein at least one intermediate position between the minimum position and the maximum position can be set by the actuator.

3. The injector arrangement of claim 1, wherein the actuator is arranged between the injector and the cylinder head, and wherein an axial extent of the actuator is adjustable.

4. The injector arrangement of claim 1, wherein the actuator is arranged tangentially around the injector.

5. The injector arrangement of claim 1, wherein the actuator is flattened in the axial direction.

6. The injector arrangement of claim 1, wherein the actuator is a piezoelectric actuator.

7. The injector arrangement of claim 1, wherein the actuator is a spacer element.

8. The injector arrangement of claim 7, wherein the actuator is a washer.

9. The injector arrangement of claim 1, wherein the actuator is a piezoelectric element-washer.

10. The injector arrangement of claim 6, wherein an axial extent of the piezoelectric actuator varies based on an amount of energization applied thereto.

11. A method, comprising:

responsive to engine load exceeding a threshold engine load, adjusting a protrusion amount of a nozzle tip of a fuel injector within a combustion chamber, the adjusting including decreasing the protrusion amount as engine load increases and increasing the protrusion amount as engine load decreases; and responsive to engine load being below the threshold engine load, maintaining the protrusion amount.

12. The method of claim 11, wherein adjusting the protrusion amount includes adjusting an energization of an actuator positioned between the fuel injector and a cylinder head forming a top surface of the combustion chamber.

13. The method of claim 12, wherein adjusting the protrusion amount includes decreasing the protrusion amount in response to increasing the energization of the actuator, and includes increasing the protrusion amount in response to decreasing the energization of the actuator.

14. The method of claim 11, wherein adjusting the protrusion amount of the nozzle tip includes protruding the nozzle tip by an increased amount only during one or more pilot injections of a single cylinder cycle and not during a main injection of the single cylinder cycle.

15. The method of claim 11, wherein adjusting the protrusion amount of the nozzle tip includes protruding the nozzle tip by an increased amount only during a main injection of a single cylinder cycle and not during pilot injections of the single cylinder cycle.

16. The method of claim 11, wherein adjusting the protrusion amount of the nozzle tip includes protruding the nozzle tip by an increased amount during each fuel injection of a single cylinder cycle, but not protruding the nozzle tip by an increased amount between each fuel injection of the single cylinder cycle.

17. The method of claim 11, wherein adjusting the protrusion amount of the nozzle tip includes protruding the nozzle tip by an increased amount during each fuel injection of a single cylinder cycle and between a start of a first pilot injection and an end of a main injection of the single cylinder cycle.

18. The method of claim 12, wherein the actuator is a piezoelectric actuator, wherein decreasing the protrusion amount comprises increasing an axial extent of the piezoelectric actuator by increasing an amount of energization applied thereto, and wherein increasing the protrusion amount comprises decreasing the axial extent of the piezoelectric actuator by decreasing the amount of energization applied thereto.

19. The method of claim 12, wherein the fuel injector comprises a tapered region which merges via a shoulder into a wider region, wherein the nozzle tip is arranged at an end of the tapered region of the fuel injector in an axial direction, and wherein the actuator rests on the shoulder and at least partially surrounds the tapered region of the fuel injector.

20. A method, comprising:

responsive to an engine load exceeding a threshold engine load, adjusting an average fuel injector nozzle protrusion amount within a combustion chamber; and responsive to the engine load being below the threshold engine load, maintaining the average fuel injector nozzle protrusion amount, wherein adjusting the average fuel injector nozzle protrusion amount includes protruding a nozzle tip by an increased amount during at least one of an intake stroke and a compression stroke of a single cylinder cycle, and includes not protruding the nozzle tip by the increased amount during at least one of an expansion stoke and an exhaust stroke of the single cylinder cycle.

* * * * *